US007588833B2

(12) United States Patent
Hashe et al.

(10) Patent No.: US 7,588,833 B2
(45) Date of Patent: Sep. 15, 2009

(54) FINE GRAINED SINTERED CEMENTED CARBIDES CONTAINING A GRADIENT ZONE

(75) Inventors: Nobom Gretta Hashe, Port Elizabeth (ZA); Susanne Norgren, Huddinge (SE); Bo Jansson, Ramsberg (SE); Alexandra Kusoffsky, Lidingö (SE); Hans-Olof Andrén, Gothenburg (SE); Johannes Henoch Neethling, Port Elizabeth (ZA)

(73) Assignees: Sandvik Intellectual Property AB, Sandviken (SE); Seco Tools AB, Fagersta (SE)

( * ) Notice: Subject to any disclaimer, the term of this patent is extended or adjusted under 35 U.S.C. 154(b) by 223 days.

(21) Appl. No.: 11/474,491

(22) Filed: Jun. 26, 2006

(65) Prior Publication Data

US 2007/0009764 A1 Jan. 11, 2007

(30) Foreign Application Priority Data

Jun. 27, 2005 (SE) ..... 0501489

(51) Int. Cl.
*B32B 18/00* (2006.01)
*C22C 29/02* (2006.01)

(52) U.S. Cl. ..... 428/552; 75/236; 75/240; 428/697; 428/698; 428/699

(58) Field of Classification Search ..... 75/236, 75/240; 428/688, 552, 697–699
See application file for complete search history.

(56) References Cited

U.S. PATENT DOCUMENTS

| | | | | |
|---|---|---|---|---|
| 4,277,283 | A | 7/1981 | Tobioka et al. | 75/238 |
| 4,548,786 | A | 10/1985 | Yohe | 419/29 |
| 4,610,931 | A | 9/1986 | Nemeth et al. | 428/457 |
| 4,649,084 | A | 3/1987 | Hale et al. | 428/552 |
| 4,708,037 | A | 11/1987 | Buljan et al. | |
| 4,830,930 | A | 5/1989 | Taniguchi et al. | 428/547 |
| 5,918,102 | A * | 6/1999 | Friederichs | 419/15 |
| 6,027,808 | A * | 2/2000 | Aoki et al. | 428/408 |
| 6,468,680 | B1 | 10/2002 | Waldenström et al. | |
| 2002/0050102 | A1 | 5/2002 | Lenander et al. | |
| 2004/0091749 | A1 * | 5/2004 | Mikus | 428/698 |
| 2004/0187638 | A1 * | 9/2004 | Heinrich et al. | 75/240 |

FOREIGN PATENT DOCUMENTS

| | | |
|---|---|---|
| EP | 0 603 143 | 6/1994 |
| EP | 0 569 696 | 10/1997 |
| EP | 0 937 781 | 8/1999 |
| EP | 1022350 A3 | 7/2000 |
| EP | 0 737 756 | 7/2002 |
| EP | 1022350 A2 | 7/2002 |

OTHER PUBLICATIONS

Hans-Olof Andrén, "Microstructure development during sintering and heat-treatment of cemented carbides and cermets", Materials Chemistry and Physics 67 (2001) pp. 209-213.

* cited by examiner

*Primary Examiner*—Roy King
*Assistant Examiner*—Ngoclan T Mai
(74) *Attorney, Agent, or Firm*—Drinker Biddle & Reath LLP

(57) ABSTRACT

There is disclosed a fine grained cutting tool insert consisting of a cemented carbide substrate and a coating. The cemented carbide substrate comprises WC, binder phase, and vanadium containing cubic carbide phase with a binder phase enriched surface zone essentially free of cubic carbide phase.

14 Claims, 3 Drawing Sheets

FINE GRAINED SINTERED CEMENTED CARBIDES CONTAINING A GRADIENT ZONE

BACKGROUND OF THE INVENTION

The present invention relates to fine-grained cemented carbides with a binder phase enriched surface zone, a so-called gradient zone. The gradient zone is essentially free from cubic carbides or carbonitrides that can form due to the addition of grain growth inhibitors. Yet, the gradient zone is fine grained.

Coated cemented carbide inserts with binder phase enriched surface zone are today used to a great extent for machining of steel and stainless materials. Thanks to the binder phase enriched surface zone, an extension of the application area for cutting tool material has been obtained.

Methods or processes to make a cemented carbide containing WC, cubic phase (carbonitride) and binder phase with binder phase enriched surface zones are within the techniques referred to as gradient sintering and are known through a number of patents and patent applications. According to U.S. Pat. Nos. 4,277,283 and 4,610,931 nitrogen containing additions are used and sintering takes place in vacuum whereas according to U.S. Pat. No. 4,548,786 the nitrogen is added as a gas. In both cases a binder phase enriched surface zone essentially depleted of cubic phase is obtained. U.S. Pat. No. 4,830,930 describes a binder phase enrichment obtained through decarburization after the sintering whereby binder phase enrichment is obtained which also contains cubic phase.

In U.S. Pat. No. 4,649,084, nitrogen gas is used in connection with sintering in order to eliminate a process step and to improve the adhesion of a subsequently deposited oxide coating. In patent EP-A-0569696 the binder phase enriched zone is obtained with the presence of Hf and/or Zr. In patent EP-0737756 the same effect is achieved with Ti present in the cemented carbide. In these patents, it is shown that cubic carbide formers of group 4A (Ti, Zr, Hf) can be used to achieve a binder phase enriched surface zone.

From a fracture mechanical point of view, an enrichment of binder metal in a surface zone means that the ability of the cemented carbide to absorb deformation and stop growing cracks from propagating. In this way a material is obtained with improved ability to resist fracture by allowing greater deformations or by preventing cracks from growing, compared to a material with mainly the same composition but homogenous structure. The cutting material, thus, exhibits a tougher behavior.

Cemented carbide inserts with a submicron structure are today used to a great extent for machining of steel, stainless steels and heat resistant alloys in applications with high demands on both toughness and wear resistance. In order to maintain the grain size during sintering such cemented carbide generally contains grain growth inhibitors. Common grain growth inhibitors include vanadium, chromium, tantalum, niobium and/or titanium or compounds involving these. The strongest inhibition is obtained using vanadium and/or chromium. When added, generally as carbides, they limit grain growth during sintering, but they also have undesirable side effects. Precipitation of unwanted brittle structure components affects the toughness behaviour in an unfavourable direction.

OBJECTS AND SUMMARY OF THE INVENTION

It is an object of this invention to provide a cemented carbide insert with a combination of high toughness and high deformation resistance at application temperatures.

In accordance with the invention, there is provided a coated cutting tool insert of a cemented carbide substrate and a coating, said substrate comprising WC, binder phase and cubic carbide phase with a binder phase enriched surface zone essentially free of cubic carbide phase, wherein the substrate comprises from about 3 to about 20 wt % cobalt, from about 0.1 to about 20 wt-% vanadium with a total content of vanadium and other cubic carbide formers from the groups 4a and 5a of from about 1 to about 20 wt-% and balance 70-95 wt % WC with an average WC grain size of less than about 1.5 μm and with no free graphite in the substrate structure.

DETAILED DESCRIPTION OF THE PREFERRED EMBODIMENTS

Figure 1:
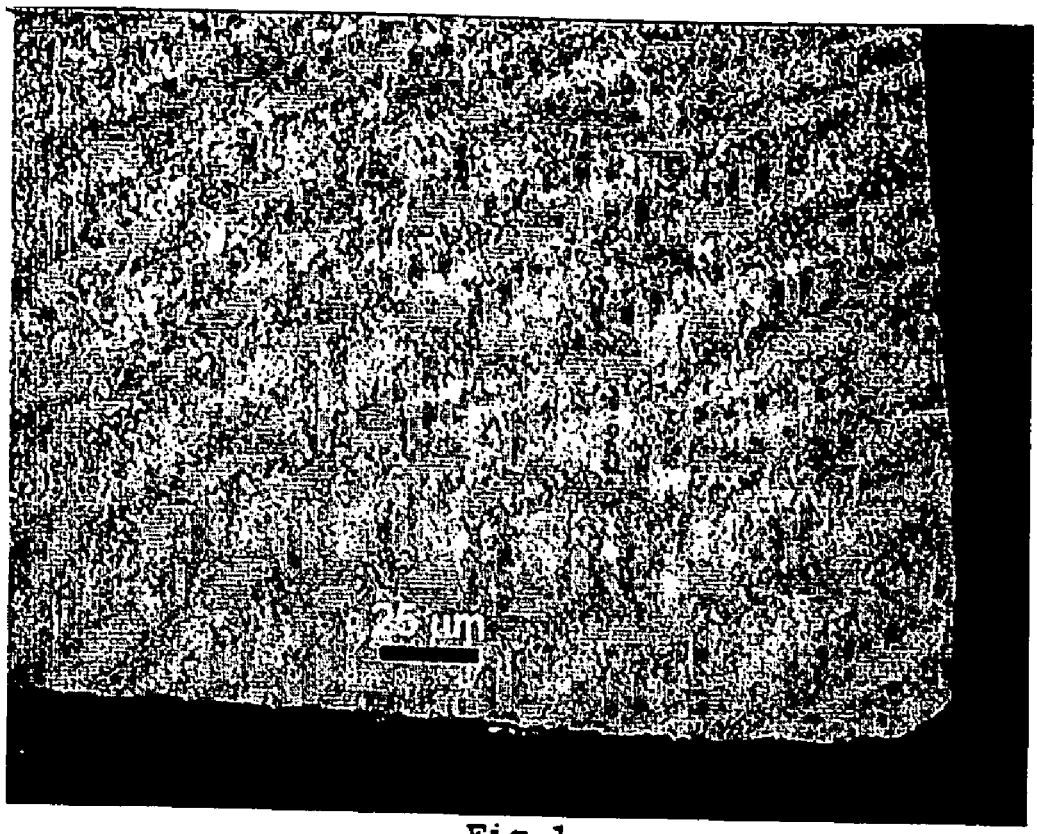
FIG. 1 shows in 500× the structure of a binder enriched surface zone according to Example 1.

The inventors have surprisingly achieved, for the first time, a fine-grained cemented carbide with a fine-grained surface zone essentially free of cubic carbide phase even though the grain growth inhibitors are not present as precipitates in the surface zone after sintering. This is achieved through the combination of fine grain size, less than about 1.5 μm, of WC-grains throughout the insert with a surface zone rich in binder phase. The role of vanadium is to prevent grain growth of the WC grains and to act as a gradient former.

The present invention concerns fine grained cemented carbide of a first phase based on tungsten carbide, WC, having an average grain size less than about 1.5 μm, preferably less than about 1.0 μm and most preferably less than about 0.6 μm, a metallic binder phase based on Co and/or Ni and finally at least one additional phase comprising at least one carbonitride or mixed carbonitride containing vanadium. The cemented carbide has a less than about 100 μm, preferably less than about 60 μm and most preferably from about 10 to about 35 μm, thick binder phase enriched surface zone essentially free of cubic carbide phase. The binder phase content of the binder phase enriched surface zone has a maximum of from about 1.2 to about 3 times the nominal binder phase content. The WC has an average size of less than about 1.5 μm close to the surface in the gradient zone as well as in the center of the cemented carbide. The composition of the cemented carbide is from about 3 to about 20 wt-% Co, preferably from about 4 to about 15 wt-% Co and most preferably from about 5 to about 13 wt-% Co, from about 0.1 to about 20 wt-% V, preferably from about 0.2 to about 10 wt-% V and most preferably from about 1 to about 10 wt-% V and as the rest WC, from about 70 to about 95 wt-% and preferably from about 80 to about 90 wt-%. Part of the V, up to about 95 wt-%, preferably up to about 80 wt-%, can be replaced by Ti alone or in combination with other elements soluble in the cubic phase e.g. Ta, Nb, Zr and Hf. The total sum of V and other elements soluble in the cubic phase is from about 1 to about 20 wt-% and preferably from about 2 to about 10 wt-%. The structure has no free graphite. Cemented carbide inserts according to the invention are preferably coated with a thin wear resistant coating with CVD-, MTCVD or PVD-technique or a combination of CVD and MTCVD. Preferably there is deposited an innermost coating of carbides, nitrides and/or carbonitride preferably of titanium. Subsequent layers consist of carbides, nitrides and/or carbonitrides preferably of titanium, zirconium and/or hafnium, and/or oxides of aluminium and/or zirconium.

According to the method to produce the cemented carbide of the present invention, cemented carbide inserts are produced by powder metallurgical methods including; milling of a powder mixture forming the hard constituents and the binder phase, drying, pressing and sintering. Sintering in nitrogen atmosphere, partly in nitrogen, or in vacuum to obtain the desired binder phase enrichment. V is added as VC or as (V,M)C or as (V,M)(C,N) or as (V,M,M)(C,N) where M is any metallic element soluble in the cubic carbide.

The invention is additionally illustrated in connection with the following examples, which are to be considered as illustrative of the present invention. It should be understood, however, that the invention is not limited to the specific details of the examples.

EXAMPLE 1

The raw materials 1, 2 and 4, given in table 1, were used for manufacturing a powder having the composition 12 wt-% Co-8.1 wt-% V balanced with WC. Inserts were pressed and sintered. The sintering was performed using $P_{N2}$=950 mbar up to T=1380° C. in order to nitride the alloy. From T=1380° C. and up to the sintering temperature, T=1410° C., the sintering was performed in vacuum. The nitrogen content of the sintered insert was 0.35 wt-% N.

TABLE 1

Raw materials.

| Raw material, No: | Raw material | Supplier | Grain size FSSS, μm |
|---|---|---|---|
| 1 | VC | H. C. Starck | 1.2-1.8 |
| 2 | WC | H. C. Starck (DS150) | 1.45-1.55 |
| 3 | TiC | H. C. Starck | 1.2-1.8 |
| 4 | Co | OMG, Extra fine granulated | 1.3-1.6 |
| 5 | $TiC_{0.5}N_{0.5}$ | H. C. Starck | 1.3-1.6 |

The structure of the surface of the cutting inserts consisted of a 75 μm thick binder phase enriched surface zone essentially free of cubic carbide phase under the clearance and rake faces and a significantly reduced gradient thickness close to the edge portion of the surface, see FIG. 1. The WC grain size was about 0.9 μm.

EXAMPLE 2

Using the same powder as in example 1 inserts were pressed and sintered. The sintering was performed using the same procedure however the pressure of $P_{N2}$=950 mbar was kept all through the sintering cycle.

Figure 2:
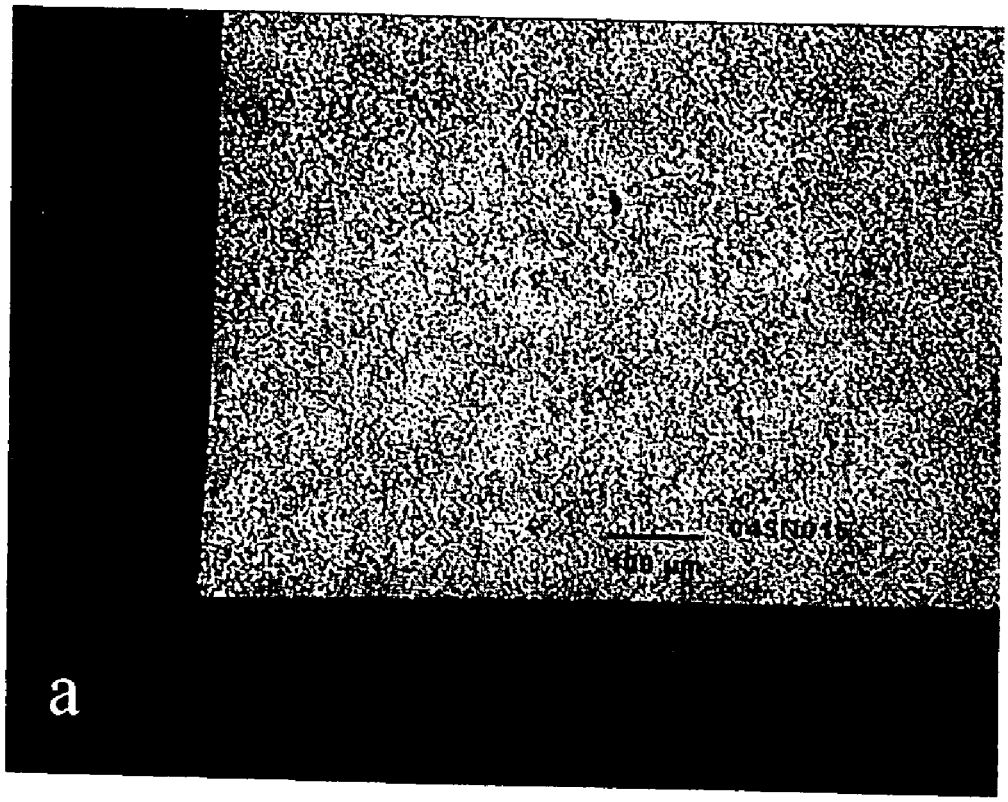
FIG. 2 shows in 100× the structure of a binder enriched surface zone according to Example 2.
Figure 3:
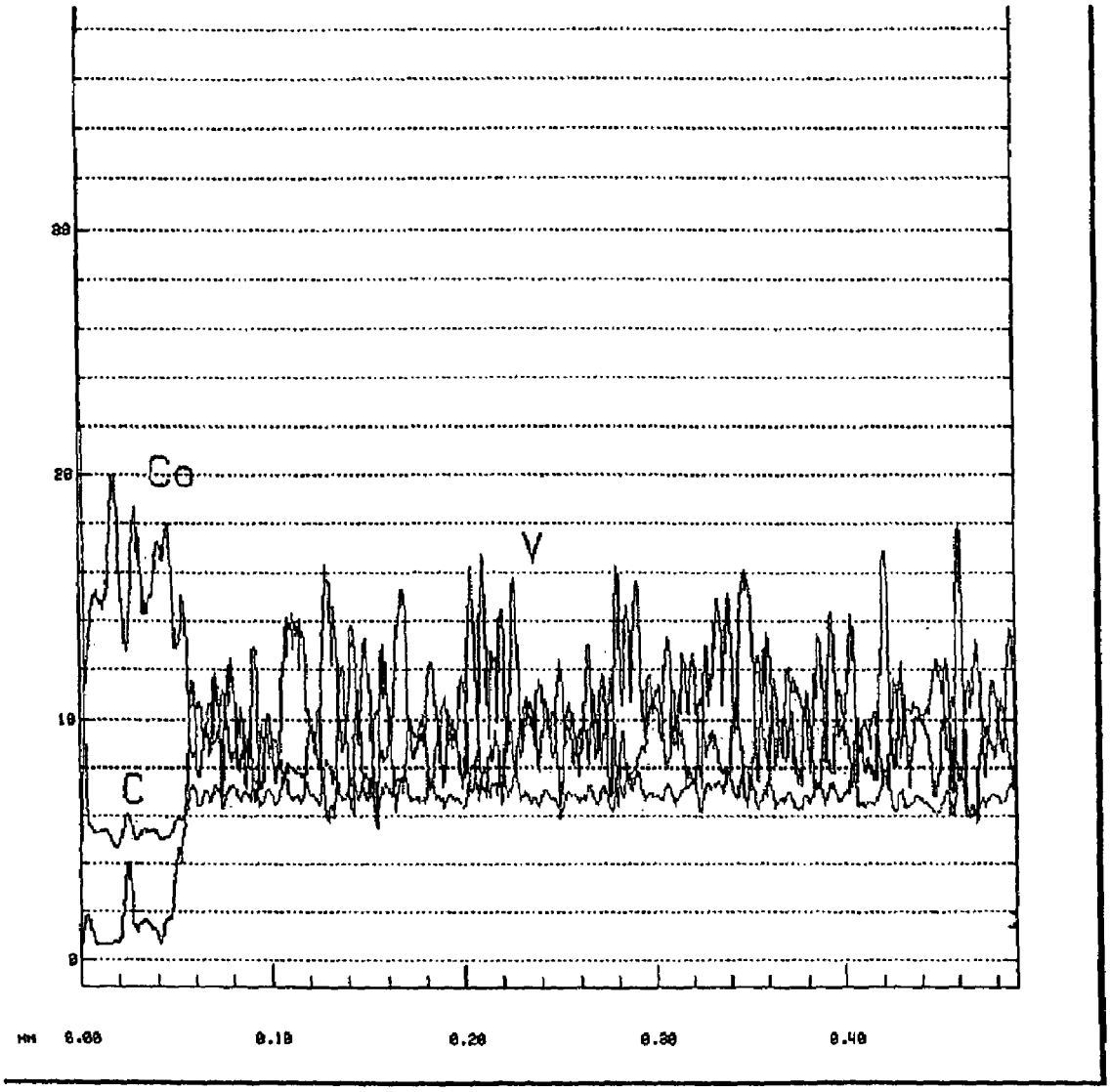
FIG. 3 shows the element distribution in the surface zone determined utilizing EPMA (Electron Probe Micro Analysis) from Example 2

The structure of the surface zone consisted of a 50 μm thick gradient binder phase enriched zone under the clearance and rake faces with a significantly reduced gradient thickness close to the edge portion of the surface, see FIG. 2. The nitrogen content of the sintered insert was 0.35 wt-%. The distribution of elements was determined utilizing EPMA (Electron Probe Micro Analysis), see FIG. 3. Note, that the surface zone is essentially free from V. The WC grain size was about 0.9 μm.

EXAMPLE 3

The raw materials 1, 2, 3 and 4 given in Table 1, were used for manufacturing a powder having the composition 13% Co-3.47% V-3.27% Ti balanced with WC.

Figure 4:
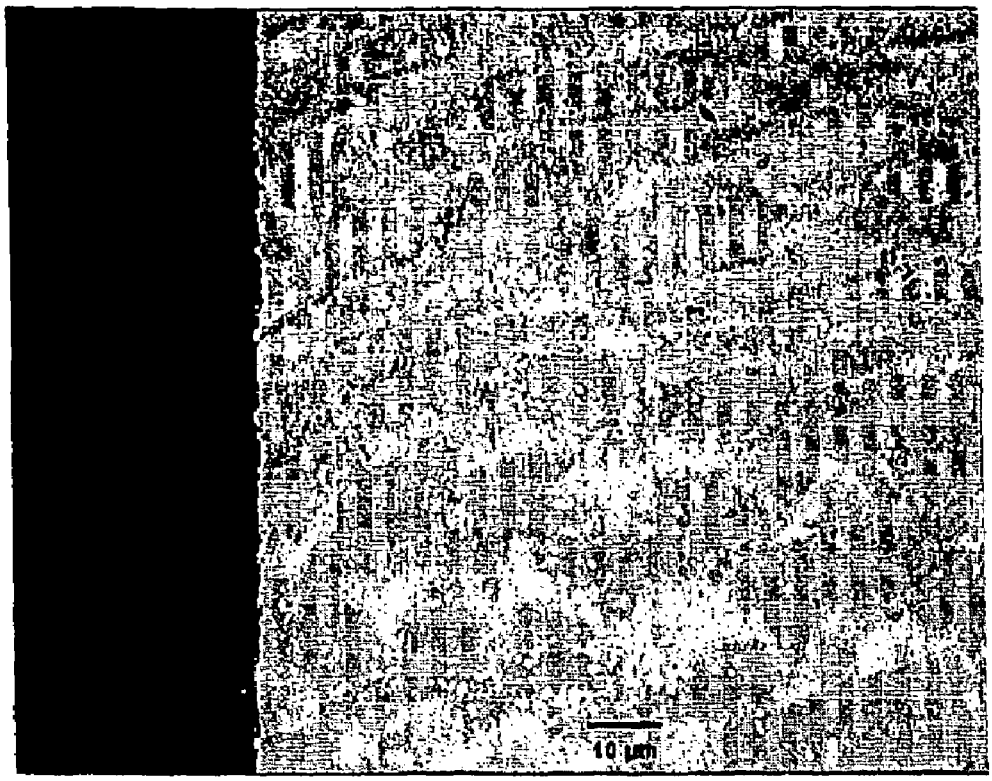
FIG. 4 shows in 1000× the structure of a binder enriched surface zone according to Example 3.

The sintering was performed as in Example 1 and the structure of the surface was a 55 μm thick binder phase surface zone under the clearance and rake faces and a significantly reduced gradient thickness close to the edge portion of the surface, see FIG. 4. The nitrogen content of the sintered insert was 0.45 wt-%. The WC grain size was about 0.9 μm.

EXAMPLE 4

The raw materials 1, 2, 3, 4 and 5 given in Table 1, were used for manufacturing a powder having the composition 13 wt-% Co-3.47 wt-% V-3.27 wt-% Ti-0.013 wt-% N balanced with WC. In order to manufacture an insert with a well defined sintered nitrogen content and a thin gradient zone nitrogen was added as $TiC_{0.5}N_{0.5}$ No 5 in table 1, in the powder mixture.

Figure 5:
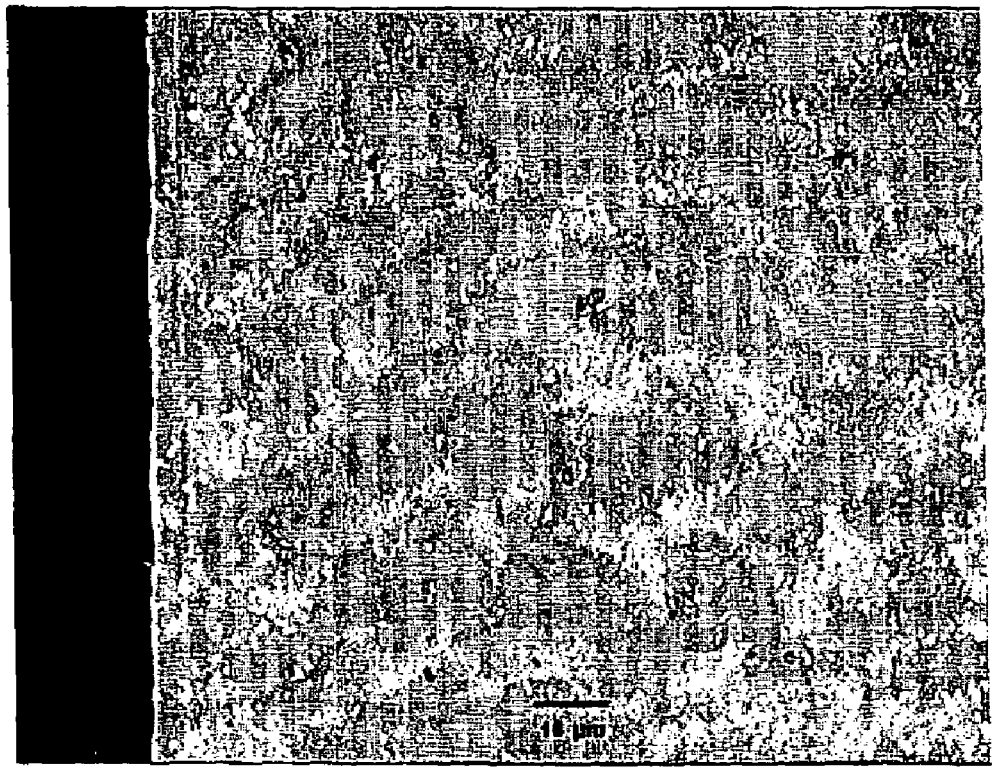
FIG. 5 shows in 1000× the structure of a binder enriched surface zone according to Example 4.

The sintering was performed in vacuum at T=1410° C. for 1 h resulting in a 12 μm thick binder phase zone under the clearance and rake faces and a significantly reduced gradient thickness close to the edge portion of the surface, see FIG. 5. The WC grain size was about 0.9 μm.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A coated cutting tool insert of a cemented carbide substrate and a coating, said substrate comprising WC, binder phase and cubic carbide phase with a binder phase enriched surface zone essentially free of cubic carbide phase, wherein the substrate comprises from about 3 to about 20 wt % cobalt, from about 0.1 to about 20 wt-% vanadium with a total content of vanadium and other cubic carbide formers from the groups 4a and 5a of from about 1 to about 20 wt-% and balance 70-95 wt % WC with an average WC grain size of less than about 1.5 μm and with no free graphite in the substrate.

2. A coated cutting tool insert of claim 1 wherein the substrate comprises from about 4 to about 15 wt % cobalt.

3. A coated cutting tool insert of claim 1 wherein the substrate comprises from about 0.2 to about 10 wt-% vanadium.

4. A coated cutting tool insert of claim 1 wherein the total content of vanadium and other cubic carbide formers from the groups 4a and 5a is from about 2 to about 10 wt-%.

5. A coated cuffing tool insert of claim 1 wherein the sintered grain size is less than about 1.0 μm.

6. A coated cutting tool insert of claim 1 wherein the substrate comprises from about 0.2 to about 6 wt-% titanium.

7. A coated cuffing tool insert of claim 1 wherein the total content of vanadium and titanium is from about 2 to about 10 wt-%.

8. A coated cuffing tool insert of claim 1 wherein the depth of the binder phase enriched surface zone is less than about 100 μm.

9. A coated cutting tool insert of claim 8 wherein the depth of the binder phase enriched surface zone is less than about 60 μm.

10. A coated cutting tool insert of claim 1 wherein the binder phase content of the binder phase enriched surface zone has a maximum of from about 1.2 to about 3 times the nominal binder phase content.

11. A coated cutting tool insert of claim 1 wherein the substrate comprises from about 3.5 to about 20 wt-% vanadium with a total content of vanadium and other cubic carbide formers from the groups 4a and 5a of from about 3.5 to about 20 wt-%.

12. A coated cutting tool insert of claim 11 wherein the substrate comprises from about 3.5 to about 8 wt-% vanadium.

13. A coated cuffing tool insert of claim 1 wherein the sintered grain size is less than about 0.6 μm.

14. A coated cutting tool insert of claim 1 wherein a total content of vanadium is sufficient to act as a gradient former.

* * * * *